US007594717B2

(12) United States Patent
Sheinman

(10) Patent No.: US 7,594,717 B2
(45) Date of Patent: Sep. 29, 2009

(54) INKJET PRINTER AND METHOD OF CONTROLLING SAME

(75) Inventor: Yehoshua Sheinman, RaAnana (IL)

(73) Assignee: Jemtex Ink Jet Printing Ltd., Lod (IL)

( * ) Notice: Subject to any disclaimer, the term of this patent is extended or adjusted under 35 U.S.C. 154(b) by 262 days.

(21) Appl. No.: 11/794,983

(22) PCT Filed: Dec. 28, 2005

(86) PCT No.: PCT/IL2005/001388

§ 371 (c)(1),
(2), (4) Date: Jul. 10, 2007

(87) PCT Pub. No.: WO2006/075314

PCT Pub. Date: Jul. 20, 2006

(65) Prior Publication Data

US 2008/0117240 A1 May 22, 2008

Related U.S. Application Data

(60) Provisional application No. 60/643,359, filed on Jan. 11, 2005.

(51) Int. Cl.
*B41J 2/18* (2006.01)

(52) U.S. Cl. ..... 347/89

(58) Field of Classification Search ..... 347/89, 347/84, 85, 86

See application file for complete search history.

(56) References Cited

U.S. PATENT DOCUMENTS 4,404,566 A * 9/1983 Clark et al. ..... 347/89
4,680,696 A * 7/1987 Ebinuma et al. ..... 347/85
6,371,607 B2 * 4/2002 Wouters et al. ..... 347/89
6,733,119 B2 5/2004 Naniwa et al.

FOREIGN PATENT DOCUMENTS

WO WO 2006/030438 3/2006

* cited by examiner

*Primary Examiner*—K. Feggins

(57) ABSTRACT

Inkjet printer apparatus includes a pressure-regulated tank having an inlet connected to an ink reservoir, and an outlet connected to a printhead including nozzles for discharging continuous streams of ink drops towards a substrate for printing thereon and gutters for intercepting the ink drops not to be printed. The apparatus further includes a bypass line between the tank outlet and the ink reservoir, a bypass control valve for controlling the flow rate via the bypass line enabling the flow rate to be preset during draining of the tank, and a pump controllable to enable pre-calibrating the pump during filling of the tank. Also described is a method of controlling an inkjet printer apparatus by determining a nominal flow rate of the pump during a non-printing operation while filling the tank to a predetermined level, and controlling the pump during a printing operation to produce a flow rate slightly below the nominal flow rate when the level of the ink in the tank is at or above the predetermined level, and a flow rate slightly above the nominal flow rate when the level of the ink in the tank is below the predetermined level.

20 Claims, 5 Drawing Sheets

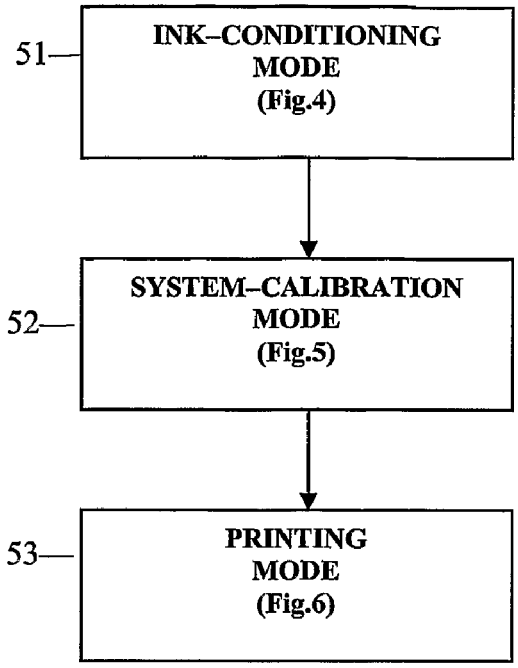
Fig.3 — Flowchart of Overall Operation
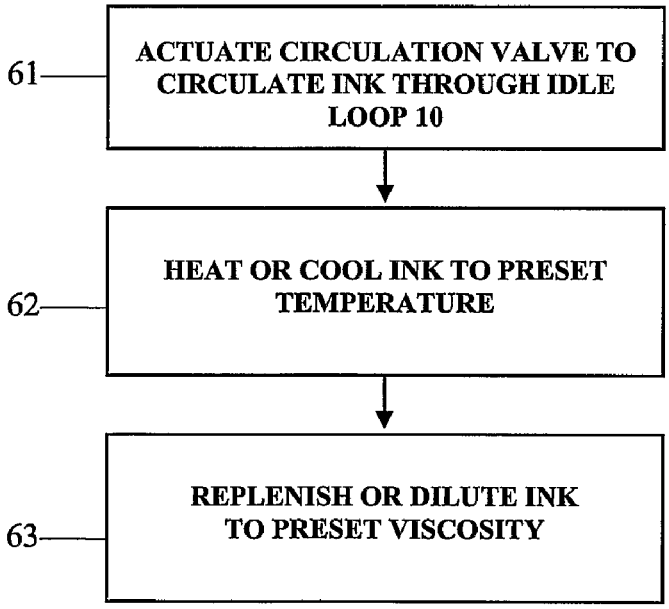
Fig.4 — Ink–Conditioning Mode

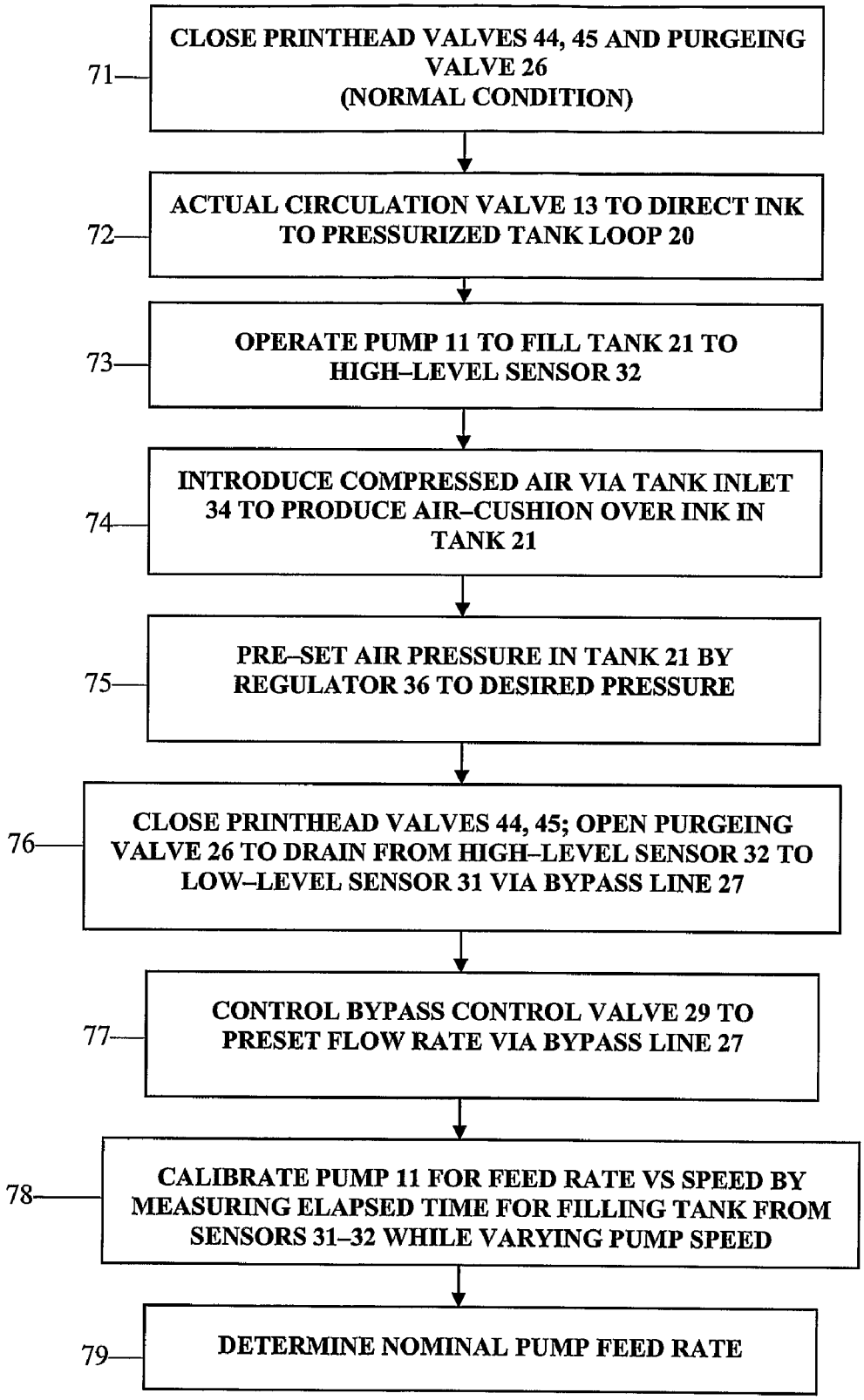
Fig. 5 — System–Calibration Mode

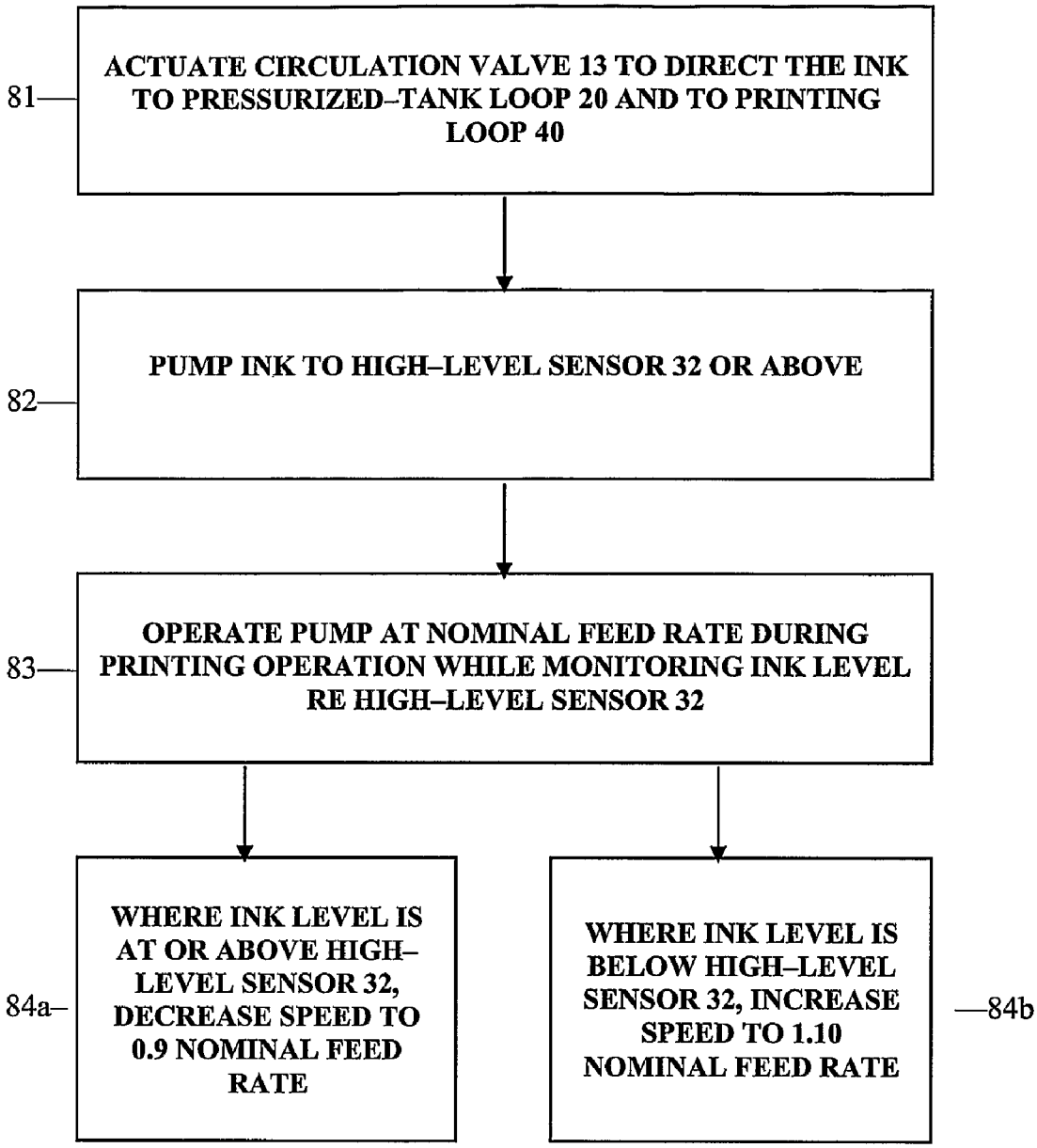
Fig.6 — Printing Mode

INKJET PRINTER AND METHOD OF CONTROLLING SAME

RELATED APPLICATIONS

This Application is a National Phase of PCT Patent Application No. PCT/IL2005/001388 having International Filing Date of Dec. 28, 2005, which claims the benefit of U.S. Provisional Patent Application No. 60/643,359 filed on Jan. 11, 2005. The contents of the above Applications are all incorporated herein by reference.

FIELD AND BACKGROUND OF THE INVENTION

The present invention relates to inkjet printers, and also to methods of controlling inkjet printers.

Inkjet printers are based on forming drops of liquid ink and selectively depositing the ink drops on a substrate. Known inkjet printers generally fall into two categories: drop-on-demand (DOD) printers, and continuous-jet (CJ) printers. Drop-on-demand (DOD) printers selectively form and deposit the inkjet drops on the substrate as and when demanded by control signals from an external data source; whereas continuous-jet (CJ) printers discharge a continuous stream of ink drops towards the substrate for printing thereon, the ink drops not to be printed being intercepted by a gutter.

Continuous-jet (CJ) printers are divided into two types of systems: binary, and multi-level deflection (MLD) systems. In binary systems, the drops are either charged or uncharged, and accordingly, either reach or do not reach the substrate at a single predetermined position. In MLD systems, the drops can receive a large number of charge levels, and accordingly can generate a large number of print positions.

Continuous jet printheads employing the Multi-Level Deflection (MLD) technique are very sensitive to the stability of the speed of the stream of drops formed by the nozzle. This sensitivity is related to the time of flight and the path of each of the drops while passing through a high electrical deflection field. Each of the drops is charged with a specific charge, corresponding to the specific required location of the drop on the printed substrate. A good first order approximation of the distance that each drop passes inside the deflection field can be presented by the equation:

$$L=\tfrac{1}{3}FL+[(\tfrac{2}{3}FL)^2+MD(T)^2]^{1/2} \quad \text{(Eq. 1)}$$

Where:

L=distance of flight

FL=the deflection field length

MD=the deflection of the drop from the undisturbed flight path, inside the deflection field. For a specific deflection field geometry and strength, and for a specific drop mass and charge, MD is dependent on T, which is:

T=the presence time of the drop in the deflection field

T itself can be presented as:

$$T=L/[Vj+\Delta Vj] \quad \text{(Eq. 2)}$$

Where:

Vj=the nominal drop speed

ΔVj=the speed variation of the drop

It is reasonable to approximate from the above formulas that:

$$MD\sim\alpha/Vj^n+\beta/\Delta Vj^n \quad \text{(Eq. 3)}$$

Where:

α, β—are constants n—equals approximately 8/3.

It is clear that any speed variation of a certain drop will change the undisturbed flight path (MD) value from the required value.

Most of the printheads which use the MLD technique are single nozzle units. For these printheads, stitching between drops delivered by adjacent nozzles is not required. Thus, the need to keep MD as accurate as possible by reducing the speed variation is minor.

On the other hand, when printing with multiple nozzle printheads and when very accurate results are required, it is extremely important to minimize MD errors.

Most of the printers currently available in the market use gear pumps in order to generate a sufficient pressure in the nozzle chamber. This pressure determines the speed of the drop via the equation:

$$P=AVj^2+B\mu Vj+C \quad \text{(Eq. 4)}$$

Where:

P—the chamber pressure

μ—the ink viscosity

A, B, C—constants.

In practical implementations, the pumping pressure cannot be ideally constant. Even a gear pump tends to create some pressure fluctuations, which are translated into MD errors. There are some solutions for these pressure fluctuations, using pressure dampeners, but in most cases significant MD errors still remain.

Pumps are driven by motors, which can be very precisely controlled. Theoretically, this is sufficient to maintain the chamber pressure constant. On the other hand, the pump efficiency relates to the viscosity of the ink (that can vary due to multiple reasons), thus closing a control loop on the pressure using the variation of the speed of the pump motor is complicated.

When the ink viscosity varies, the speed of the drops (for a certain chamber pressure) might vary, as clear from the above equation. This complicates the control loop mentioned above to a non-reasonable complexity, which makes it non-reliable, and a major contributor to artifact MD errors.

Some of the available printers attempt to avoid the pump regulation issue through an air-cushion, i.e., an "air over ink" device. This device is an air-pressurized tank which has two internal level indicators: One level indicates "full" condition, and the other indicates "empty" condition. The tank is filled with compressed air, which is easy to accurately and precisely regulate using commercial devices. In these devices, the ink pump fills the compressed tank, through a primary port, until the indicator indicates "full". Meanwhile, the ink is delivered to the printhead through a secondary port at a pressure that is close to the preset air pressure compressing the tank. After the ink level reaches the "full" condition, the ink pump stops and the tank is drained very slowly (as this device supports only one or couple of nozzles) till the indicator indicates "empty". This causes the ink pump to start again to fill the tank. If the pump is slow enough, the tank is big enough, the drain rate (the consumption of the nozzle or nozzles) is small enough, and the precise air regulator can support the air volume change in the tank without fluctuation (jiggle), the ink pressure in the nozzle chamber will be much more stable than the similar pressure supported by a controlled gear pump solution. In this case, the MD errors will be reduced dramatically.

However, in multiple nozzle devices (some hundreds of nozzles per device), this solution would not be practical.

Multiple nozzle devices require a by-pass flow of the ink inside the printhead, in order to maintain a thermal stability in all the nozzle pressure chambers, which ensures viscosity stability while jetting drops from all the nozzles. The practical meaning of this is that only a small percent of the delivered ink volume is jetted, while most of the delivered ink is by-passed and recirculated back to the ink reservoir. In these consumption conditions, the above-described solution would require a large, high volume, costly cylinder, and a large amount of circulated ink in the system, together with a highly accurate air regulator. Some applications require using an elevated temperature of the ink (above the room temperature) in order to avoid variations in the ink (that might cause color variations). Typically, the ink itself must be heated gently to avoid its separation. Large volumes of ink in the system would require enormous conditioning time. All these disadvantages make the above-described pressurized cylinder techniques impractical in a multiple nozzle apparatus.

OBJECTS AND BRIEF SUMMARY OF THE PRESENT INVENTION

One object of the present invention is to provide an inkjet printer having advantages in the above respects. Another object of the invention is to provide a method of controlling an inkjet to provide a number of advantages, as will be described more particularly below.

According to one aspect of the present invention, there is provided an inkjet printer, comprising: an ink reservoir for holding a supply of liquid ink; a printhead including at least one nozzle for discharging a continuous stream of ink drops towards a substrate for printing thereon, a gutter for intercepting the ink drops not to be printed, an inlet for receiving ink from the ink reservoir, and an outlet for returning to the ink reservoir the ink not printed on the substrate; a pressure-regulated tank having an ink inlet connected to the ink reservoir for receiving ink therefrom, and an ink outlet connected to the printhead inlet for supplying pressurized ink thereto; a bypass line between the tank outlet and the ink reservoir for directing the ink from the tank to the ink reservoir while bypassing the printhead; and a bypass control valve in the bypass line for controlling the flow rate of ink via the bypass line from the tank outlet to the ink reservoir enabling the flow rate to be preset according to a desired value.

In the described preferred embodiment, the printer further comprises a purgeing valve connected between the tank outlet and the bypass line and adapted to be opened in order to enable the bypass control valve to be preset or pre-calibrated while the bypass line directs ink from the tank to the ink reservoir to bypass the printhead. The tank includes a high-level sensor and a low-level sensor defining a known volume between the sensors, such that the bypass control valve may used to preset the flow rate by measuring the elapsed time during which the ink in the tank drains from the high-level to the low-level.

According to further features in the described preferred embodiments, the printer further comprises a pump between the ink reservoir and the tank inlet for pressurizing the ink supplied to the tank to a desired pressure, the pump being controllable to enable presetting or pre-calibrating the pump during the filling of the tank. The tank includes a high-level sensor and a low-level sensor defining a known volume between the sensors, such that the pump may be preset or pre-calibrated by measuring the elapsed time during which the tank is filled with ink from the low-level to the high-level.

As will be described more particularly below, the foregoing features of the invention are particularly advantageous when the printhead includes a plurality of nozzles each capable of discharging a continuous stream of ink drops towards the substrate for printing thereon, and a plurality of gutters each for intercepting the ink drops not to be printed by its respective nozzle and for returning same via the printhead outlet to the ink reservoir.

According to another aspect of the present invention, there is provided a method of controlling an inkjet printer comprising an ink reservoir for holding a supply of liquid ink; a printhead including at least one nozzle for discharging a continuous stream of ink drops towards a substrate for printing thereon during a printing operation, a gutter for intercepting the ink drops not to be printed, an inlet for receiving ink from the ink reservoir, and an outlet for returning to the ink reservoir the ink not printed on the substrate; and a pressure-regulated tank having an ink inlet connected to the ink reservoir for receiving ink therefrom, an ink outlet connected to the printhead inlet for supplying pressurized ink thereto, and a sensor for sensing a predetermined level of ink in the tank; the method comprising: determining a nominal flow rate of the pump for pumping the liquid ink through the printhead; operating the pump to fill the tank to or above the predetermined level during a non-printing operation; and controlling the pump during a printing operation to produce a flow rate slightly-below the nominal flow rate when the level of the ink in the tank is at or above the predetermined level, and a flow rate slightly-above the nominal flow rate when the level of the ink in the tank is below the predetermined level.

Preferably, the slightly-below flow rate is 0.85-0.95, more preferably about 0.9, of the nominal flow rate; whereas the slightly-above flow rate is preferably 1.05-1.15, more preferably about 1.10, of the nominal flow rate.

As will be described more particularly below, the above-described features enable inkjet printers to be constructed and operated with a minimum undisturbed flight path (MD) errors without the need for large-volume, costly pressure-regulated tanks for this purpose. This makes the printer and method particularly useful with multiple-nozzle printheads.

Further features and advantages of the invention will be apparent from the description below.

BRIEF DESCRIPTION OF THE DRAWINGS

The invention is herein described, by way of example only, with reference to the accompanying drawings:

FIG. 3 is a diagram illustrating the overall operation of the illustrated inkjet printer;

FIG. 4 is a flow chart illustrating the System-Conditioning mode in the diagram of FIG. 3;

FIG. 5 is a flow chart illustrating the System-Calibration Mode in the diagram of FIG. 3;

and FIG. 6 is a flow chart illustrating the Printing Mode in the diagram of FIG. 3.

It is to be understood that the foregoing drawings, and the description below, are provided primarily for purposes of facilitating understanding the conceptual aspects of the invention and possible embodiments thereof, including what is presently considered to be a preferred embodiment. In the interest of clarity and brevity, no attempt is made to provide more details than necessary to enable one skilled in the art, using routine skill and design, to understand and practice the described invention. It is to be further understood that the embodiments described are for purposes of example only, and that the invention is capable of being embodied in other forms and applications than described herein.

DESCRIPTION OF A PREFERRED EMBODIMENT

Figure 1:
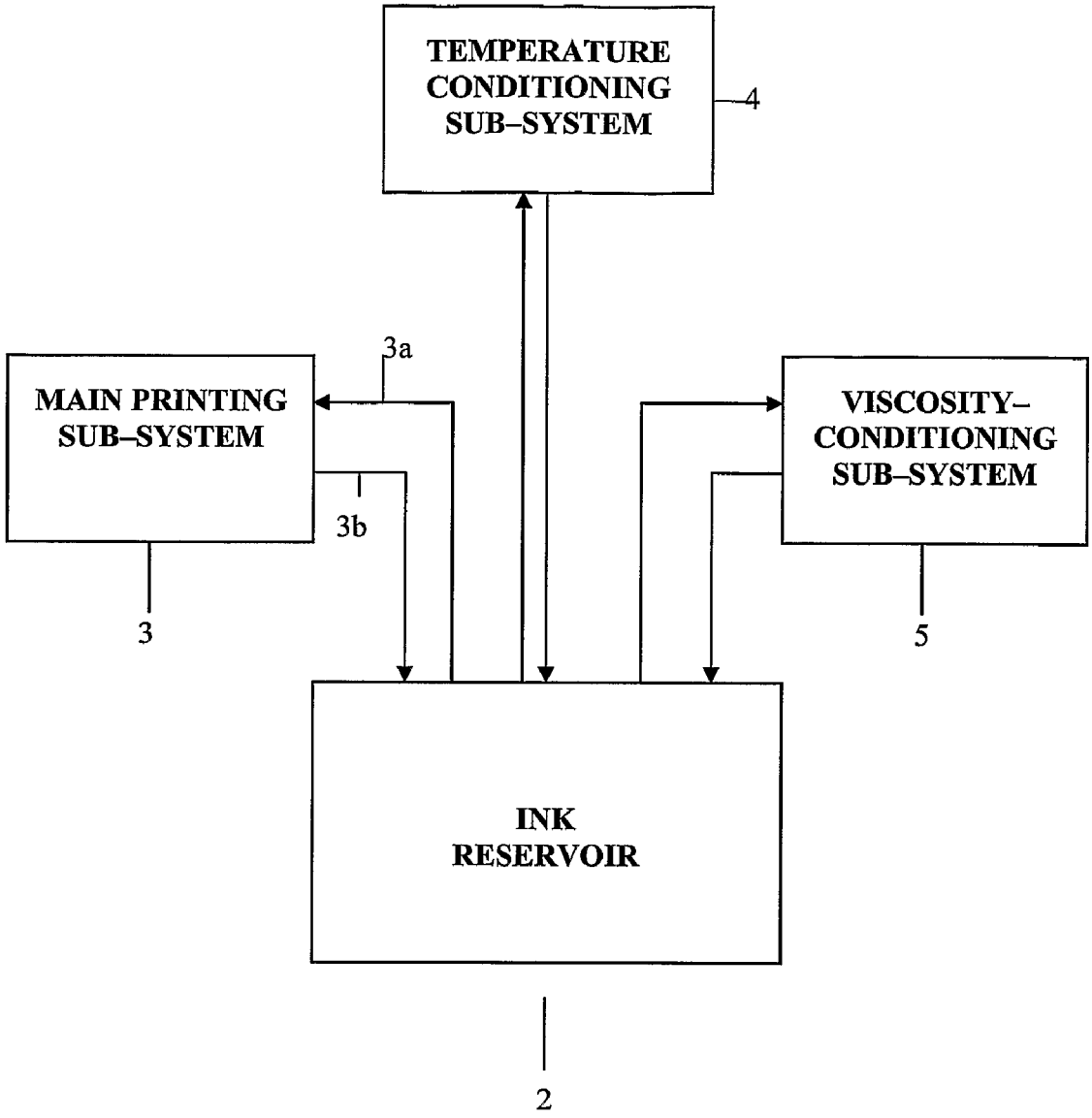
FIG. 1 is a block diagram illustrating the main ink-circulation sub-systems in an inkjet printer constructed in accordance with the present invention.
Figure 2:
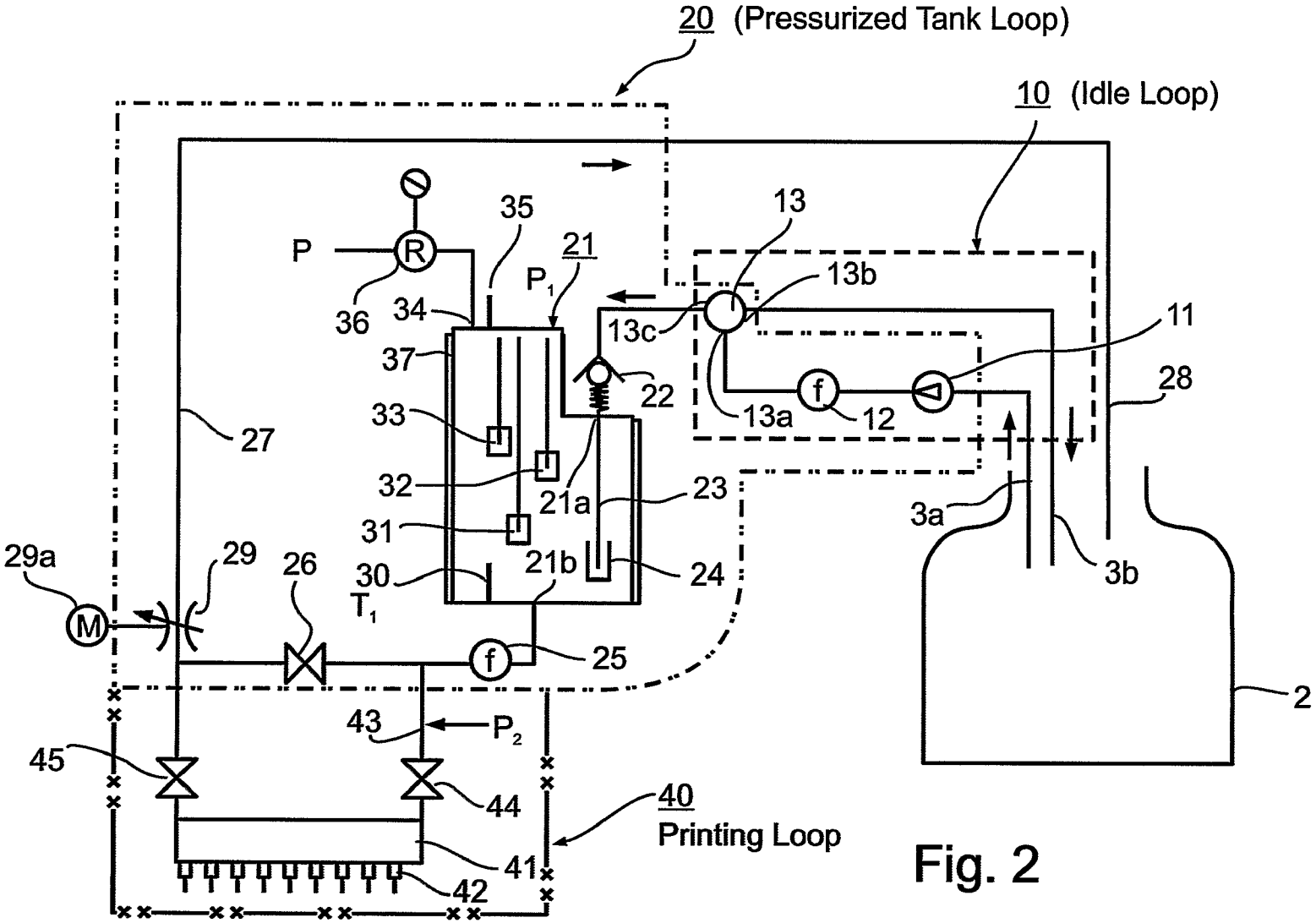
FIG. 2 is a schematic diagram illustrating the main printing sub-system in the system of FIG. 1.

FIGS. 1 and 2 illustrate a preferred construction of an inkjet printer in accordance with the present invention, and FIGS. 3-6 illustrate a preferred mode of operation of such a printer for (among other advantages) obviating the need for a large-volume expensive pressure-regulated tank while still minimizing the undisturbed flight path (MD) of ink drops produced by the printer.

Inkjet Printer Construction (FIGS. 1 and 2)

Overall Construction

The inkjet printer described below as a preferred embodiment of the present invention includes an ink circulation system schematically illustrated in FIG. 1. Such an ink circulation system includes a tank 2, which serves as the main ink reservoir for holding a supply of liquid ink; and a main printing sub-system 3, which includes the printhead. As described below, the printhead communicates with the ink reservoir to receive via line 3*a* the ink for printing on a substrate, and to return via line 3*b* the ink not printed on the substrate. The ink circulation system further includes a temperature-conditioning sub-system 4 communicating with the main ink reservoir via lines 4*a*, 4*b* to cool the ink to the correct preset temperature; and a viscosity-conditioning system 5, also communicating with the main ink reservoir via lines 5*a*, 5*b* to replenish the ink, or dilute it, to ensure maintaining a preset viscosity despite evaporation, etc. from the ink during its circulation in the system. As shown in FIG. 1, the ink is continuously circulated from the main ink reservoir 2 to each of the sub-systems 3, 4, 5, to maintain the preset temperature and viscosity in the ink circulated through the main, printing sub-system 3.

Printing Sub-System 3 (FIG. 2)

The present invention is concerned primarily with the main, printing sub-system 3, which communicates with the ink reservoir 2, via lines 3*a* and 3*b*. The main, printing sub-system 3 is more particularly illustrated in FIG. 2. It includes three liquid loops, namely: an idle loop generally designated 10; a pressure-regulating loop, generally designated 20; and a printing loop, generally designated 40.

The idle loop 10 includes a pump 11 that pumps the liquid ink from the main ink reservoir through line 3*a*, and a filter 12 for removing impurities, to the inlet 13*a* of a circulation valve 13. In its normal condition, circulation valve 13 directs the liquid ink via its outlet 13*b* back to the ink reservoir 2 via line 3*b*. Circulation valve 13, however, can be actuated to direct the ink via its outlet 13*c* to the pressure-regulating loop 20.

The pressure-regulating loop 20 includes a pressure-regulated tank 21 having an inlet 21*a* connected via a check valve 22 to outlet 13*c* of circulation valve 13 so as to receive the liquid ink from ink reservoir 2 as pumped by pump 11. Inlet 21*a* of tank 21 is connected by a feed tube 23 to feed the liquid ink to the bottom of tank 21 via a mesh filter 24. Tank 21 includes an ink outlet 21*b* at the bottom of the tank for feeding the ink therein via another filter 25 to the printing loop 40 containing the printhead for printing on a substrate, as will be described more particularly below.

Ink outlet 21*b* of tank 21 is also connected, via filter 25 and a purgeing valve 26, to a bypass line 27 for bypassing the printing loop 40, and for connecting the tank outlet 21*b* back to the ink reservoir 2 via an inlet conduit 28. Bypass line 27 includes a bypass control valve 29, controllable by a controller 29*a* for controlling the flow rate of the ink via the bypass line 27 from the tank outlet 21*b* to reservoir 2 according to a desired value. As will be described more particularly below, controller 29*a* of bypass control valve 29 enables the flow rate to be preset according to the desired value. Bypass control valve 29 may be a needle valve controlled by motor controller 29*a*.

Tank 21 further includes a temperature sensor 30 for sensing the temperature of the ink within the tank.

Tank 21 further includes three ink-level sensors, namely: low-level sensor 31, high-level sensor 32, and emergency sensor 33. Level sensors 31-33 may be floats, conductivity electrodes, or any other liquid-level sensor. They, particularly the low-level sensor 31 and the high-level sensor 32, are located at known distances from each other, such that they define known volumes between them. This feature is utilized to enable presetting or pre-calibrating the bypass control valve 29 and also the feeding pump 11, as will be described more particularly below.

Tank 31 further includes a compressed air inlet 34 at the upper end of the tank for pressurizing the tank by an air cushion over the liquid ink therein. The pressure of the air cushion is sensed by a pressure sensor 35, and is regulated by a pressure regulator 36.

Tank 21 is externally covered by a heating blanket 37 preventing heat dissipation from the conditioned ink inside the tank to the ambient. The temperature of the ink inside the tank, as monitored by temperature sensor 30, may be transmitted externally of the tank in any suitable manner.

Printing loop 40 includes a printhead 41 having a plurality of nozzles 42 each capable of discharging a continuous stream of ink drops towards the substrate (not shown) for printing thereon. The ink is supplied to the nozzles 42 via an ink inlet 43 connected to the ink outlet 21*b* of tank 21 via an inlet valve 44. Printhead 41 further includes a plurality of gutters (not shown) each for intercepting the ink drops not to be printed by its respective nozzle, and for returning the intercepted ink via an ink outlet 45 to the main ink reservoir 2 via bypass line 27. The pressure of the inletted ink inletted via line 43 is sensed by a pressure sensor 46.

Printhead 41 may be of any desired construction, such as one of those described in our prior U.S. Pat. Nos. 5,969,733, 6,003,980 and 6,106,107.

Operation

The operation of the above-described inkjet printer is more clearly described below with respect to the flow charts of FIGS. 3-6.

Overall Apparatus Operation (FIG. 3)

The overall operation of the illustrated apparatus, as shown by the diagram of FIG. 3, includes three modes, namely: the Ink-Conditioning Mode 51, as more particularly illustrated in FIG. 4; the System-Calibration Mode 52, as more particularly illustrated in FIG. 5; and the Printing Mode 53, as more particularly illustrated in FIG. 6.

Normally, when the printer is first turned-on, it will be operated in the above three modes according to the sequence illustrated in FIG. 3. However, it will be appreciated that whenever desired while in the Printing Mode, the system can be operated according to the Ink-Conditioning Mode to recondition the ink, or according to the System-Calibration Mode to recalibrate the system, whenever it appears appropriate.

The Ink Conditioning Mode (FIG. 4)

For operating the printer in the Ink-Conditioning Mode illustrated in FIG. 4, circulation valve 13 is actuated to circulate the ink through the idle loop 10 into and out of the main tank reservoir 2, as indicated by block 61. During this circulation of the ink through the idle loop, the temperature-conditioning system 4 (FIG. 1) is effective to heat or cool the ink to the desired preset temperature; and the viscosity-conditioning system 5 of FIG. 1 is effective to replenish or dilute the ink to the preset viscosity, e.g., to make-up for evaporation losses or any other factors tending to change the viscosity.

System Calibration Mode (FIG. 5)

One purpose of this mode is to preset or calibrate the bypass control valve 29 in order to produce a preset or desired rate of ink flow via the bypass line 27 during the Printing Mode. Another important purpose of the System-Calibration Mode is to calibrate pump 11 to show how the pump feed rate varies with speed, which information is also used during the Printing Mode. As described below, the presetting of the bypass control valve 29 is effected during a draining operation of the pressure-regulated tank 21; whereas the calibration of the pump 11 is effected during an ink-pumping operation into the tank.

As shown in FIG. 5, in this mode the printhead valves 44 and 45 are closed (normal condition), and purge valve 26 is also closed (normal condition), to thereby disconnect the pressurized tank loop 20 from the printing loop 40, and also from the bypass line 27, as indicated by block 71 in FIG. 5.

Circulation valve 13 is actuated to direct the liquid ink from reservoir 2, via outlet 13*c* to the pressurized-tank loop 20, as indicated by block 72. Pump 11 is then operated to fill tank 21 to or slightly-above the high-level sensor 32 (block 73) while compressed air is introduced via tank inlet 34 to produce an air-cushion over the ink volume in tank 21, as indicated by block 74. The air pressure in tank 25 is then preset by regulator 36 to the desired value (block 75).

With printhead valves 44 and 45 still closed, purgeing valve 26 is opened, to drain the liquid ink from the tank via bypass line 27, while measuring the elapsed time of draining of the ink from the high-level sensor 32 to the low-level sensor 31 (block 76). Since the volume between these two sensors is known, a measurement of such elapsed time will produce a measurement of the flow rate of the ink through bypass line 27 back to the reservoir 2. Bypass control valve 29 in bypass line 27 may be varied by controller 29*a* to preset the flow rate to a desired value.

This draining operation may be repeated many times in order to calibrate the bypass control valve 29 to different values. Thus, the system utilizes the known volume between the high-level sensor 32 and the low-level sensor 31 to produce a measurement of the flow rate of the ink back to the main reservoir 2 via the bypass line 27 during a draining operation. It will be appreciated that emergency-level sensor 33, or any other sensor within tank 21 enabling a precise determination to be made of ink volume within the tank, can be used for producing this measurement of flow rate.

Pump 11 may then be calibrated by measuring the elapsed time for filling the tank from the low-level 31 sensor to the high-level sensor 32 while varying the pump speed in order to produce a curve of feed-rate versus pump speed (block 78). A nominal pump feed rate may then be determined (block 79), e.g. while the printing loop 40 is disabled (by valves 43 and 45 and purge valve 26 being closed), or while a printing operation is performed by a nominal printing pattern. This nominal pump feed rate is used during the Printing Mode, as described below with respect to the flow chart of FIG. 6.

Printing Mode (FIG. 6)

In the Printing Mode, illustrated by the flow chart of FIG. 6, circulation valve is actuated to direct the liquid ink from pump 11 via outlet 13*c*, first to the pressurized-tank loop 20, and from there to the printing loop 40. It will be appreciated that for this purpose printhead valves 44 and 45 are both open, whereas purgeing valve 26 is closed.

At the beginning of the Printing Mode, pump 11 is operated to pump the ink into tank 21 to the high-level sensor 32 (block 82).

During the printing operation, the plurality of nozzles 42 in the printhead 41 discharge continuous streams of ink drops towards the substrate. Some of these drops are intercepted by the substrate, but most are intercepted by gutters included in the printhead and are returned via outlet valve 45 and bypass line 27 to the main ink reservoir 2. Accordingly, the ink within tank 21 must be continuously replenished according to the amount of ink intercepted by the substrate. In the conventional inkjet printer, this replenishment of the ink within tank 21 is generally effected by the low-level sensor 31 which, when reached by the liquid ink within the tank, actuates pump 11 to pump more liquid ink into the tank to the high-level sensor 32. As indicated earlier, not only does this require large-volume tanks, particularly where the printhead included multiple nozzles, but also this large variation in the ink volume within the tank makes it extremely difficult to accurately maintain the preset pressure within the tank, thereby causing undisturbed flight path (MD) errors.

In the apparatus illustrated in the drawings, however, only the high-level sensor 32 is used for controlling the pump speed during a printing operation. Thus, as shown by block 83, FIG. 6, pump 11 is operated at the pre-calibrated pump speed to produce a flow rate slight-below the previously-determined Nominal Flow Rate when the level of the ink in tank 21 is at or above the pre-determined level of the high-level sensor 32 (block 84); and when the ink level is below the high-level sensor 32, the pump speed is increased so as to increase the flow rate slightly above the nominal flow rate (block 85).

Preferably, the slightly-below flow rate is 0.85-0.95, more preferably about 0.9 of the nominal flow rate; whereas the slightly-above flow rate is preferably 1.05-1,15, more preferably about 1.10, of the nominal flow rate.

Since the ink level in the pressurized tank 21 will change very little, the pressure within the tank will be maintained relatively constant, thereby substantially minimizing changes in the undisturbed flight path (MD) of the ink drops. The above-described arrangement thus obviates the need for large-volume tanks in multiple-nozzle inkjet printing systems, thereby reducing the cost and size of such systems.

While the invention has been described with respect to one preferred embodiment, it will be appreciated that this is set forth merely for purposes of example, and that many other variations, modifications and applications of the invention may be made.

What is claimed is:

1. An inkjet printer, comprising:

an ink reservoir for holding a supply of liquid ink;

a printhead including at least one nozzle for discharging a continuous stream of ink drops towards a substrate for printing thereon, a gutter for intercepting the ink drops not to be printed, an inlet for receiving ink from said ink reservoir, and an outlet for returning to said ink reservoir the ink not printed on said substrate;

a pressure-regulated tank having an ink inlet connected to said ink reservoir for receiving ink therefrom, and an ink outlet connected to said printhead inlet for supplying pressurized ink thereto;

a bypass line between said tank outlet and said ink reservoir for directing the ink from said tank to said ink reservoir while bypassing said printhead;

and a bypass control valve in said bypass line for controlling the flow rate of ink via said bypass line from the tank outlet to said ink reservoir enabling said flow rate to be preset according to a desired value.

2. The printer according to claim 1, wherein the printer further comprises a purgeing valve connected between said tank outlet and said bypass line and adapted to be opened in order to enable said bypass control valve to be preset or pre-calibrated while said bypass line directs ink from said tank to said ink reservoir to bypass said printhead.

3. The printer according to claim 2, wherein said tank includes a high-level sensor and a low-level sensor defining a known volume between said sensors, such that said bypass control valve may used to preset said flow rate by measuring the elapsed time during which the ink in the tank drains from said high-level to said low-level.

4. The printer according to claim 1, wherein the printer further comprises a pump between said ink reservoir and said tank inlet for pressurizing the ink supplied to said tank to a desired pressure, said pump being controllable to enable presetting or pre-calibrating the pump during the filling of said tank.

5. The printer according to claim 4, wherein said tank includes a high-level sensor and a low-level sensor defining a known volume between said sensors, such that said pump may be preset or pre-calibrated by measuring the elapsed time during which the tank is filled with ink from said low-level to said high-level.

6. The printer according to claim 1, wherein said pressure-regulated tank includes a compressed air inlet for pressurizing the tank by an air cushion over the liquid ink therein, a pressure sensor for sensing the pressure in said tank, and a controller for controlling the inletted compressed air in response to said sensed pressure.

7. The printer according to claim 1, wherein said printhead includes a plurality of nozzles each capable of discharging a continuous stream of ink drops towards the substrate for printing thereon, and a plurality of gutters each for intercepting the ink drops not to be printed by its respective nozzle and for returning same via said printhead outlet to said ink reservoir.

8. The printer according to claim 1, wherein said bypass control valve is a motorized needle valve.

9. The printer according to claim 1, wherein said apparatus further comprises: a pump between said ink reservoir and said tank inlet for pressurizing the ink supplied to said tank to a preset pressure; and a purgeing valve connected between said tank outlet and said bypass line;

and wherein said tank includes a high-level sensor and a low-level sensor defining a known volume between said sensors, such that said pump may be used to preset or pre-calibrate the pump flow-rate by measuring the elapsed time during which the pump is operated in order to fill the tank with ink from said low-level to said high-level, and said bypass control valve may be preset or pre-calibrated by measuring the elapsed time during which the ink in the tank drains from said high-level to said low-level while said purgeing valve is open.

10. The printer according to claim 9, wherein said pressure-regulated tank includes a compressed air inlet for pressurizing the tank by an air cushion over the liquid ink therein, a pressure sensor for sensing the pressure in said tank, and a controller for controlling the inletted compressed air in response to said sensed pressure.

11. A method of controlling an inkjet printer, comprising:

an ink reservoir for holding a supply of liquid ink;

a printhead including at least one nozzle for discharging a continuous stream of ink drops towards a substrate for printing thereon during a printing operation, a gutter for intercepting the ink drops not to be printed, an inlet for receiving ink from said ink reservoir, and an outlet for returning to said ink reservoir the ink not printed on said substrate;

and a pressure-regulated tank having an ink inlet connected to said ink reservoir for receiving ink therefrom, an outlet connected to said printhead inlet for supplying pressurized ink thereto, and a sensor for sensing a predetermined level of ink in said tank;

said method comprising:

determining a nominal flow rate of the pump for pumping the liquid ink through said printhead;

operating said pump to fill the tank to or above said predetermined level during a non-printing operation;

and controlling said pump during a printing operation to produce a flow rate slightly-below said nominal flow rate when the level of the ink in said tank is at or above said predetermined level, and a flow rate slightly-above said nominal flow rate when the level of the ink in said tank is below said predetermined level.

12. The method according to claim 11, wherein said inkjet printer is comprises an ink reservoir for holding a supply of liquid ink;

a printhead including at least one nozzle for discharging a continuous stream of ink drops towards a substrate for printing thereon, a gutter for intercepting the ink drops not to be printed, an inlet for receiving ink from said ink reservoir, and an outlet for returning to said ink reservoir the ink not printed on said substrate;

a pressure-regulated tank having an ink inlet connected to said ink reservoir for receiving ink therefrom, and an ink outlet connected to said printhead inlet for supplying pressurized ink thereto;

a bypass line between said tank outlet and said ink reservoir for directing the ink from said tank to said ink reservoir while bypassing said printhead;

and a bypass control valve in said bypass line for controlling the flow rate of ink via said bypass line from the tank outlet to said ink reservoir enabling said flow rate to be preset according to a desired value.

13. The method according to claim 11, wherein said slightly-below flow rate is 0.85-0.95 of the nominal flow rate.

14. The method according to claim 11, wherein said slightly-below flow rate is about 0.9 of the nominal flow rate.

15. The method according to claim 11, wherein said slightly-above flow rate is 1.05-1.15 of the nominal flow rate.

16. The method according to claim 11, where said slightly-above flow rate is about 1.10 of the nominal flow rate.

17. The method according to claim 11, wherein said inkjet printer further comprises a bypass line between said tank outlet and said ink reservoir for directing the ink from said tank to said ink reservoir while bypassing said printhead; and a bypass control valve in said bypass line;

and wherein said method further comprises presetting or pre-calibrating said bypass control valve during a draining operation of the tank.

18. The method according to claim 16, wherein said tank includes a high-level sensor and a low-level sensor defining a known volume, such that said nominal flow rate of the pump may be measured by measuring the elapsed time during the filling of the tank from said low-level to said high-level, and said bypass control valve may be preset or pre-calibrated by measuring the elapsed time the draining of said tank from said high-level to said low-level.

19. The method according to claim 11, wherein said printhead includes a plurality of nozzles each capable of discharging a continuous stream of ink drops towards the substrate for printing thereon, and a plurality of gutters each for intercepting the ink drops not to be printed by its respective nozzle and for returning same via said printhead ink outlet to said ink reservoir.

20. The method according to claim 11, wherein said pressure-regulated tank includes a compressed air inlet for pressurizing the tank by an air cushion over the liquid ink therein, a pressure sensor for sensing the pressure in said tank, and a controller for controlling the inletted compressed air in response to said sensed pressure.

* * * * *